United States Patent [19]

Westerlund

[11] 3,991,858

[45] Nov. 16, 1976

[54] LOCKING DEVICE FOR A DOOR

[75] Inventor: Tage Westerlund, Skelleftea, Sweden

[73] Assignee: Linden-Alimak AB, Skelleftea, Sweden

[22] Filed: Apr. 9, 1974

[21] Appl. No.: 459,436

[30] Foreign Application Priority Data

Apr. 26, 1973 Sweden ..... 7305872

[52] U.S. Cl. ..... 187/61; 187/31; 187/57

[51] Int. Cl.[2] ..... B66B 13/20

[58] Field of Search ..... 187/47–52, 187/57, 59, 61, 31; 292/197, 207, 302

[56] References Cited

UNITED STATES PATENTS

| | | | |
|---|---|---|---|
| 671,878 | 4/1901 | Coyle | 187/61 |
| 1,595,559 | 8/1926 | McLauthlin | 187/61 |
| 1,598,678 | 9/1926 | Dunlop | 187/61 X |
| 1,835,544 | 12/1931 | Werner | 187/61 |
| 1,979,022 | 10/1934 | Borden et al. | 187/61 X |
| 2,484,679 | 10/1949 | Borden | 187/61 X |
| 3,659,677 | 5/1972 | Shalders | 187/61 |
| 3,721,319 | 3/1973 | Hall et al. | 187/61 |

FOREIGN PATENTS OR APPLICATIONS

| | | | |
|---|---|---|---|
| 1,052,866 | 1/1954 | France | 187/61 |
| 1,205,671 | 11/1965 | Germany | 187/61 |
| 1,047,977 | 11/1966 | United Kingdom | 187/61 |

*Primary Examiner*—John J. Love
*Assistant Examiner*—James L. Rowland
*Attorney, Agent, or Firm*—Fred Philpitt

[57] ABSTRACT

A locking device for a holding door on an elevator shaft including a barrier member that is interconnected to a locking arm, said locking arm being alternately engageable and disengageable with a stop means so that the barrier member can only be moved out of way of the holding door when the elevator is adjacent to the holding door.

7 Claims, 5 Drawing Figures

LOCKING DEVICE FOR A DOOR

Figure 1:
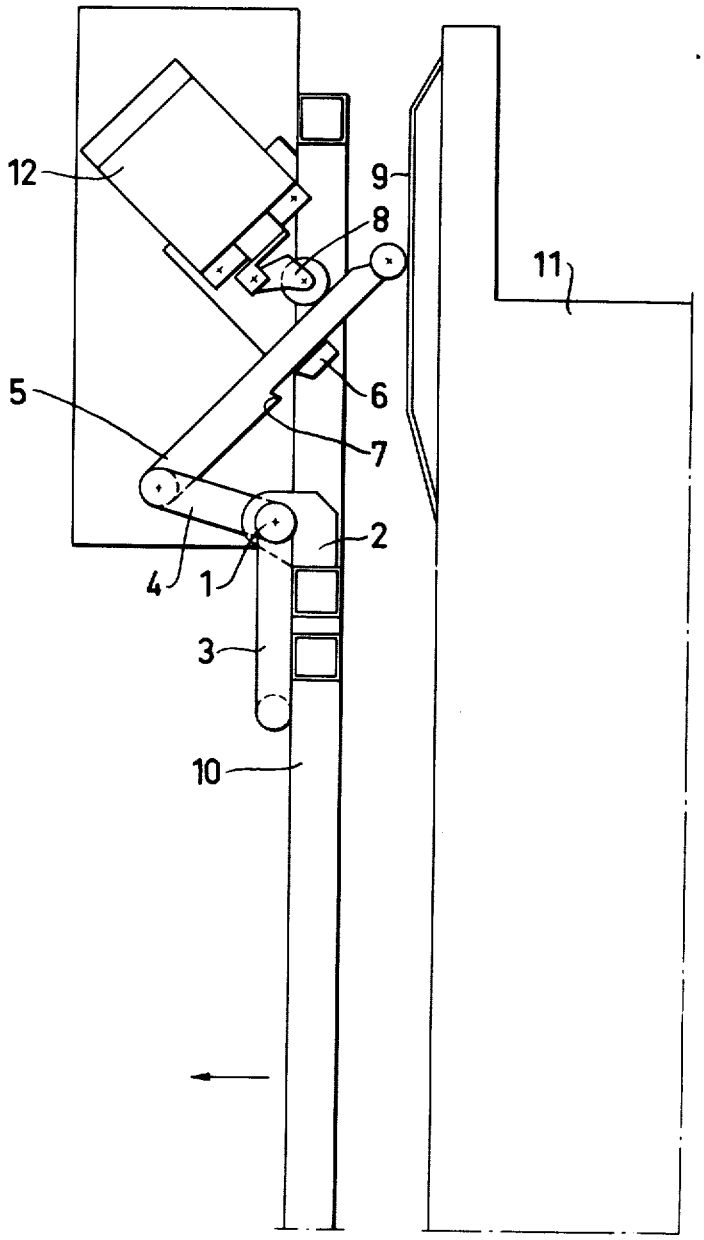

At most types of elevators it is required that the doors at the holding floors should be locked electrically as well as mechanically and can only be opened, when the elevator cage is being braked or has stopped at a holding floor. Opening of the locking means of the relative shaft doors is carried out by means of a locking path placed on the elevator cage, which controls a locking device mechanically, when it is straight in front of this. The locking path can be either stationary or movable, i.e. in the latter case at mechanical or electrical control it can be moved outwards towards the opposite wall of the hoist shaft, when it is desired to open a shaft door. At elevators with a stationary locking path the mechanical locking is opened and closed in most cases at each holding floor being passed.

It is the object of the invention to produce a locking device with reliable function under hard, external conditions and which is particularly adapted for use with building elevators, which are placed outdoors and thus exposed to great changes in temperature and other weather conditions. An improvement of previously known locking devices is obtained by the locking device being characterized by an elongated, substantially straight lock arm, which is so actuated by the opening motion of the door that the lock arm at attempts to open the door tries to be displaced in its longitudinal direction in one direction, the opening motion of the door being prevented, when the door is to be locked, due to the fact that the lock arm is prevented from moving in said direction by a stationarily adapted shoulder by means of a stop adapted on the lock arm, the lock arm being pressed at its longitudinal side against the shoulder by means of a resilient means, the door being blocked, and when the door is to be unlocked the lock arm is adapted to be moved against the action of the resilient means not to be in contact with the shoulder so that the stop of the lock arm upon opening the door does not get in contact with the shoulder and the lock arm can move freely in the longitudinal direction of the arm in said one direction and the opening motion of the door is not prevented in this way.

The locking device of the invention has a sturdy construction and contains only a few movable parts, which will not seize against each other.

Although the locking device of the invention has been produced to be used with elevators, it is extremely suitable for use with doors, where it is desired to remote control locking and unlocking. In this case the unlocking device can consist of a device with electromagnetical reciprocal action, or, if the lock arm is of ferromagnetic material, of an electromagnet.

At elevators the electrical control of the door being closed in as a rule carried out by means of contact pins in the doorcase. As the electrical control in this case overlaps the mechanical locking it is possible at the most usual locking devices, when the elevator passes the door of a holding floor, to move the door out of its position, enough for the mechanical locking not to be able to lock the door again when the elevator cage has passed. This takes place without the electrical control starting operation and stopping the elevator. At the locking device according to the invention it is possible instead of or as a supplement to the control mentioned above to arrange a control via the resilient means by having the motion of the resilient means actuating a switch means entering a position, preferably a closed one, when the lock arm makes contact with the shoulder, and another position, preferably a broken one, when the lock arm is moved away from the shoulder, or else the resilient means can have an electrically conductive element following the motion of the means, which makes contact with two conductive pins, at the position taken by the means when the lock arm makes contact with the shoulder, and brings about a conductive connection between them, and which at the position taken by the means when the lock arm does not make contact with the shoulder, is not in contact with the pins. In this way a control is obtained, which is directly dependent on the fact whether the locking device is in locking position or not. When the locking device is used with a door of a holding floor at a hoist shaft, the switch means or the conductive pins can be connected in the circuit of the elevator so that the elevator cannot be started or be in motion if the circuit is not closed, which it is only when the lock arm makes contact with the shoulder.

When the locking device is used with a holding floor door of a hoist shaft, unlocking is best effected by one end of the lock arm projecting into the hoist shaft and, when the door is to be opened, being adapted to be moved so that the lock arm does not make contact with the shoulder of a locking path of conventional type arranged on the elevator cage, it not being possible to open the holding floor door, when the locking path of the elevator is not straight opposite to the locking device. In case a movable locking path is used no unlocking takes place unless the locking path is moved outwards.

If the shoulder at a closed door is at a definite distance from the stop in the longitudinal direction of the lock arm and the length of the arm is adapted so that the lock arm is a short way from the locking path, when the latter is straight opposite to the lock arm, a stationary locking path can be used and the elevator can pass a holding floor without the locking path of the elevator cage touching the arm, and in this way the arm and the locking path will only get in contact with each other when the door is opened and the arm is then extended. Of course this is a very great advantage as a movable locking path is a complicated and sensitive equipment. The locking device of the invention might together with a stationary locking path even be used at high-speed elevators, as no forces arise in passing the lockings at the holding floors.

The invention will be described more in detail with reference to the enclosed drawings, wherein FIG. 1 shows a side view of a first embodiment of the locking device according to the invention.

Figure 2:
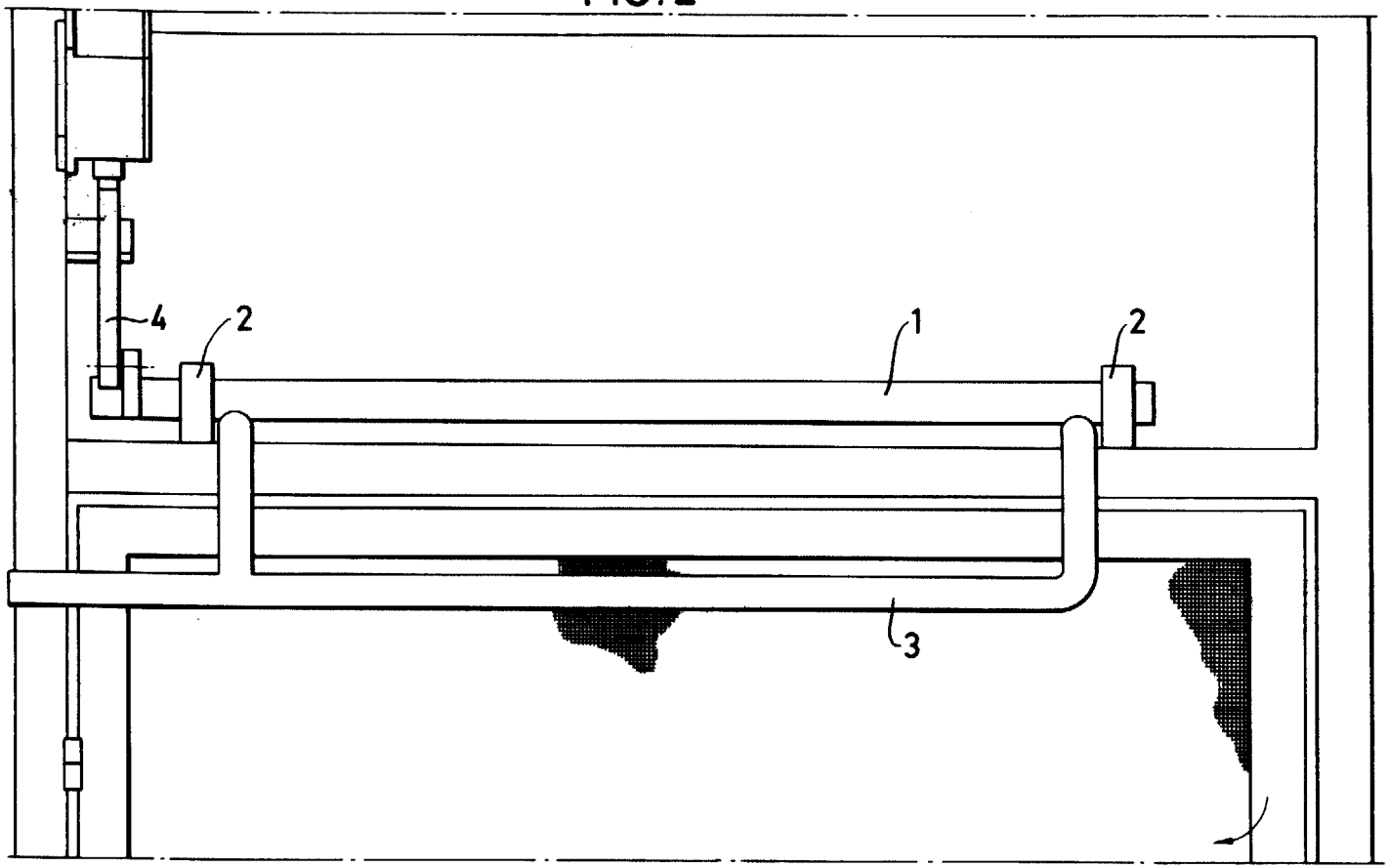

FIG. 2 shows a front view of the locking device according to FIG. 1.

Figure 3:
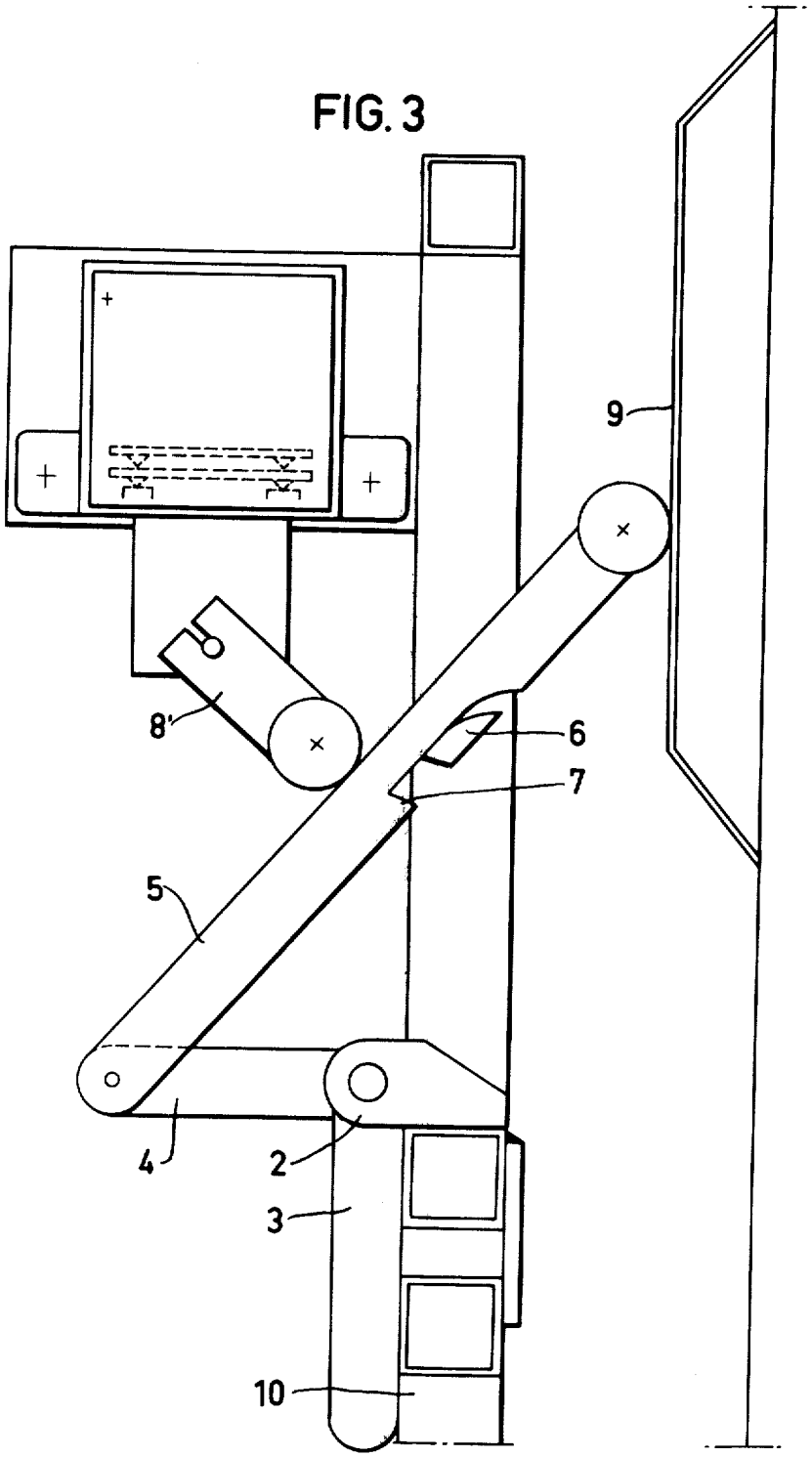
Figure 4:
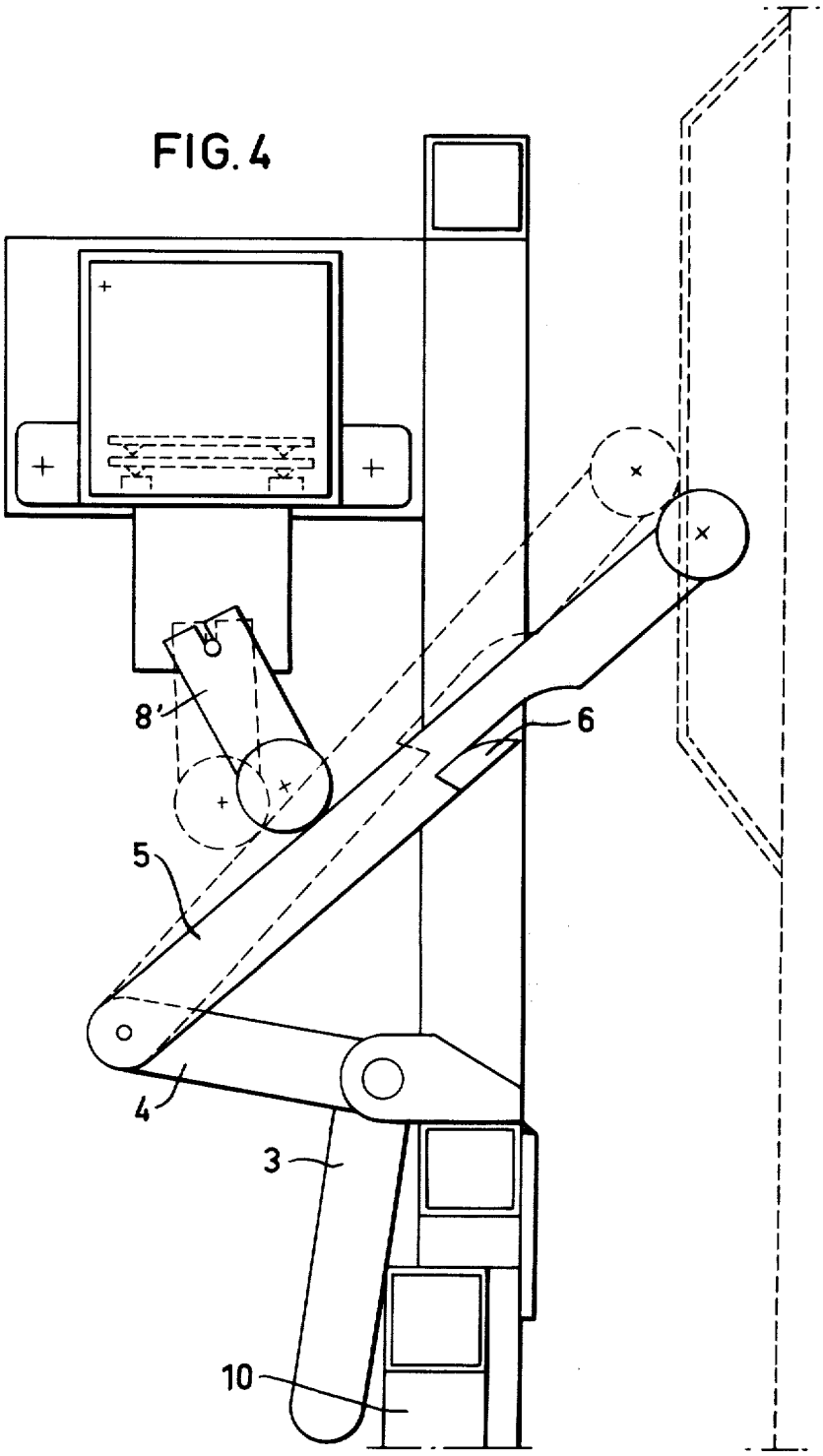
Figure 5:
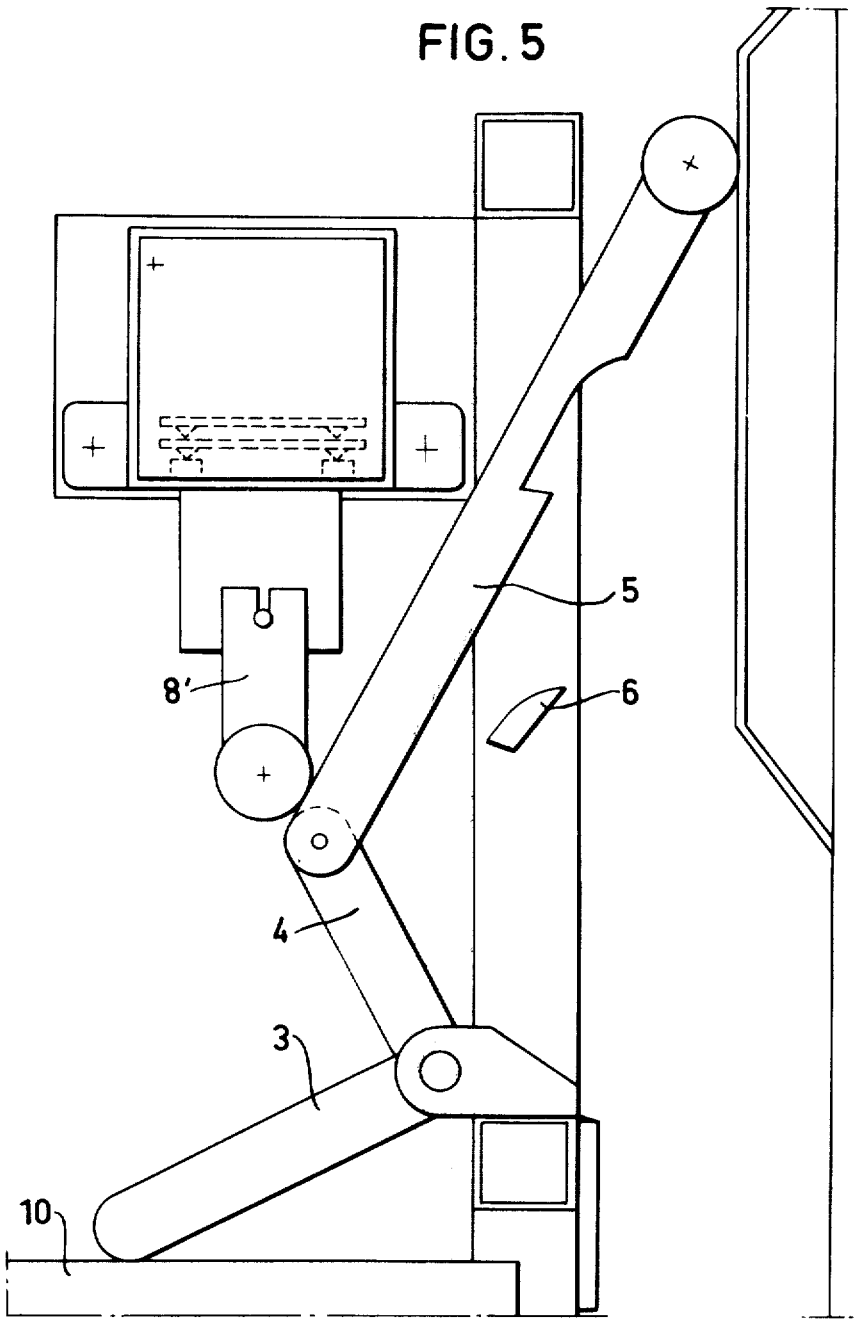

FIG. 3 shows a side view of a second embodiment of the locking device with the door closed. FIG. 4 shows a side view of the second embodiment of the locking device with the door partially opened. FIG. 5 shows a side view of the second embodiment of the locking device with the door completely opened.

FIGS. 1 and 2 show a side view and a front view of a first embodiment of the locking device according to the invention arranged at a holding floor door 10 of a hoist shaft. Directly in front of the door 10 there is an elevator cage 11 with a stationary locking guide 9. Above the door 10 an axle 1 is arranged in holders 2 rigidly mounted in the shaft wall. On the axle 1 an operating lever 3 is attached, which rests against the door side of the holding floor door 10 towards the opening and is arranged to be lifted by the door when it is opened. The operating lever 3 extends in a lateral direction so that it protrudes at the edge of the hinge so far that the operating lever 3 does not fall down in front of the door when this is wide open, and is so far extended towards the edge opposite to the edge of the hinge that on opening the door, when the door is to be locked, the force exerted on the operating lever 3 due to the lever effect should not be so great that any part of the locking device is damaged and so that the motion of the lever 3 caused by the motion of the door should be sufficient in order that the elements included in the locking device at a locked door should not enter locking position even if the door is only opened to a narrow opening.

As the operating lever 3 in this way will be very extended laterally, it consists in the embodiment shown, see especially FIG. 2, of a stiff rail 3 running parallel to the axle 1 and attached to the axle by means of two bars. This embodiment saves material in comparison with a massive operating lever arranged along the whole axle and has the same function.

On the axle 1 a lever 4 is also attached, at one end of which a lock arm 5 is pivotedly attached. The lock arm 5 is pressed against a stationarily arranged shoulder 6 by means of a resilient means 8. The lock arm 5 is provided with a stop 7, which prevents the lock arm from moving towards the elevator cage in the longitudinal direction of the lock arm when the stop makes contact with the shoulder, the door being blocked as the operating lever 3 cannot be moved upwards by the door when the elevator is not at the holding floor, with the locking guide directly opposite to the locking device. The shoulder 6 and the stop 7 are so designed that a safe grip between them is obtained, it not being possible for the lock arm 5 to slide upwards when it is in its locking position.

When the locking guide is directly opposite to the locking means, the lock arm 5 cannot move in its longitudinal direction but must move upwards against the action of the resilient means 8, and therefore the stop 7 cannot be moved towards the shoulder 6, and nothing prevents movement of the operating lever 3 so that this can move upwards unimpededly and the door 10 can be opened.

As there is a certain space between the stop 7 and the shoulder 6 along the longitudinal direction of the lock arm 5, when the door is closed, the locking device can be operated with a stationary locking guide instead of a movable one, which will give a very simple operation, as movable locking guides are complicated and sensitive. If it is seen to it that the operating end of the locking arm 5 will be a short way from the locking guide at a closed door 10 and the locking device is thus only actuated if the door would be opened, the advantage is obtained that the elevator can pass a holding floor without the locking guide of the elevator cage contacting the locking arm 5, the arm and the locking guide only coming in contact with each other, when the door is opened and the arm is then extended. The forces occurring in usual cases, when a stationary locking guide is used, will not arise between the locking guide and locking device, when the elevator passes the lockings at the holding floors. No rattle will then arise for this reason, nor any strains on the locking devices.

The resilient means 8 cooperates with a switch means 12, which is actuated by the motion of the resilient means so that the switch means enters a first closed position when the lock arm 5 makes contact with the shoulder 6, and a second broken position, when the lock arm is moved away from the shoulder, and the resilient means has thus been pushed obliquely upwards. The switch 12 is included in the operating circuit of the elevator in such a way that the voltage supply to the drive circuit of the elevator is interrupted so that the elevator cannot start or be moved from a holding floor, if the switch 12 is not closed. Moreover, the elevator stops if a door at a holding floor would be pulled open just as the elevator passes this holding floor. It is essential when the locking device is used with an elevator that the switch 12 really is in a closed position, when the door is locked or is in closed position, as if the switch could not be closed e.g. due to oxide coating on one contact plate or the like the only thing happening would be that the elevator could not start from a holding floor, and thus full safety is achieved by this regarding the elevator so that no shaft door can be open when there is no elevator at that holding floor. Such safety could not be achieved if the switch should have a broken position at closed and locked door. The switch 12 must also be of such a type that breaking is obtained with certainty when the resilient means is preset by the lock arm 5 at open holding floor door. A very good way of establishing this certainty is obtained if the resilient means has an electrically conductive element following the motion of the resilient means, which element lies close to two spaced, conductive pins at the position taken by the means when the lock arm 5 makes contact with the shoulder, and brings about a conductive connection between them, and which at the position taken by the means when the lock arm is not in contact with the shoulder does not lie close to the pins. The conductive element is then included as a part of the switch.

In case the locking device of the invention should not be arranged at a holding floor door, the switch can of course be adapted to be broken at closed and locked door and closed at open door. It should be noted that the switch should be closed when the door enters a position, at which it is desired that a function is to be activated that must not be activated when the door enters another position. This is essential.

FIG. 3–5 show side views of another embodiment of the locking device of the invention in different positions. The parts corresponding with FIGS. 1 and 2 have received the same reference numerals as in these figures. FIG. 3 shows the locking device at closed door. It is apparent from the figure that the locking device enters the same position at closed door, the locking guide 9 being directly in front of the locking arm 5 or not. FIG. 4 shows the locking device, when the door is just opened. The position of the locking device is shown with continuous lines, when no locking guide is directly in front of the locking means and the door should thus be locked, and the position of the locking device with dotted lines, when a locking guide is directly in front of the locking device and the door should be unlocked. Here it is seen that very small motion of the door can cause a great motion of the locking device. The difference will be greater the further the operating lever is extended towards the opening edge of the door (see FIG. 2). FIG. 5 shows the position of the locking device at completely open door. The essential difference between the two embodiments shown is the design of the resilient means. In the device according to FIG. 1 the resilient means moves obliquely upwards, when the lacking arm 5 is moved upwards and in FIG. 3–5 the means is instead moved to the left and is again resilient when moved to the right. A switch, preferably in the form of a limit switch, cooperates with the resilient means 8, which switch is operated by the resilient means so that the switch is broken when the resilient means is in the left position and closed when the resilient means is in the right position. The switch is connected in the operating circuit of the elevator in the same way as the switch according to FIG. 1. For a safe operation of the locking device of the invention all the parts sliding against each other must be constructed so that this sliding is as frictionless as possible. Wherever this is the case, the one part has in both the embodiments shown been provided with a wheel, which moreover can be mounted in ball or roller bearings. It is also possible to coat one or both the parts with a material having a low coefficient of friction, e.g. nylon, perlon, teflon or the like.

In both the embodiments here shown the locking device of the invention has been used with hinged doors. The locking device can also be used with sliding doors, the operating lever 3 then being arranged at the rear edge of the door and adapted to enter a substantially vertical position at a closed door and be moved to a substantially horizontal position, when the door is opened. When the locking device is to be used at an elevator with a sliding door and the locking arm 5 must thus protrude into the hoist shaft, the motion of the operating lever must turn by 90°, but this is no technical problem and can be carried out in several ways.

What is claimed is:

1. A locking device for an elevator door, said locking device comprising in combination:

a. a barrier member mounted adjacent the upper edge of a door and in a direction transverse to the movement direction of the door, said barrier member resting against the door in the closed position of the door and adapted to be raised by the door above the upper edge of the door when the door is opened, b. an elongated lock arm, c. an arrangement of levers for operatively connecting said barrier member with said elongated lock arm, said arrangement of levers including an elongated axle member, a first lever member connecting said axle member to one end of said lock arm and a second lever member connecting said axle to said barrier member, d. stop means associated with one portion of said lock arm, e. a stationary shoulder, f. resilient means which normally biases said stop means against said shoulder, and g. guide means for said lock arm, said guide means being positioned to guide said elongated lock arm in a path which will overcome the biasing action of said resilient means when the door is to be opened, h. said barrier member being held in a raised position by the door itself when the door is open.

2. A locking device according to claim 1 wherein said barrier member is a rail.

3. A locking device according to claim 2 wherein said elevator door is hinged and said axle member is mounted adjacent the upper edge of the hinged door and in a direction transverse to the hinged edge of the door and wherein the rail extends laterally beyond the hinged edge of the door and that the rail extends at least to the middle of the door.

4. A locking device according to claim 1 wherein said resilient means is operatively connected with an electrical switch means and said switch means is in turn connected with the electrical circuit of an elevator, so that when the normal biasing action of the resilient means is overcome by the combined action of said lock arm and said guide means, said electrical switch means will be activated so as to automatically inactivate that portion of the electrical circuit of the elevator that causes raising or lowering of the elevator.

5. A locking device according to claim 1 wherein one end of said locking arm is adapted to extend into an elevator shaft.

6. A locking device according to claim 1, wherein said guide means is mounted on an elevator cage.

7. A locking device according to claim 6 wherein the end of the locking arm that extends into an elevator shaft extends a distance such that it will not contact the guide means on the elevator cage unless the elevator cage is opposite the elevator door and the barrier member is moved toward a position to open the elevator door.

* * * * *